US011473836B1

(12) United States Patent
Humann et al.

(10) Patent No.: US 11,473,836 B1
(45) Date of Patent: Oct. 18, 2022

(54) CONTAINER HOLDER

(71) Applicant: International Name Plate Supplies Ltd., London (CA)

(72) Inventors: David Humann, London (CA); Thomas Freeman, St. Thomas (CA); Ethan Gagie, London (CA); Jason Moerman, Lucan (CA)

(73) Assignee: INTERNATIONAL NAME PLATE SUPPLIES LTD., London (CA)

( * ) Notice: Subject to any disclaimer, the term of this patent is extended or adjusted under 35 U.S.C. 154(b) by 0 days.

(21) Appl. No.: 17/714,542

(22) Filed: Apr. 6, 2022

Related U.S. Application Data

(63) Continuation-in-part of application No. 17/209,797, filed on Mar. 23, 2021, now abandoned.

(30) Foreign Application Priority Data

Aug. 13, 2021 (CA) ..... 3128493

(51) Int. Cl.
*A47K 1/08* (2006.01)
*F25D 31/00* (2006.01)
*F25D 3/08* (2006.01)

(52) U.S. Cl.
CPC ..... *F25D 31/007* (2013.01); *F25D 3/08* (2013.01); *F25D 2303/0841* (2013.01); *F25D 2303/08222* (2013.01)

(58) Field of Classification Search
CPC ..... F25D 3/07; F25D 31/007; F31D 3/08
See application file for complete search history.

(56) References Cited

U.S. PATENT DOCUMENTS 3,848,766 A * 11/1974 Gantt ..... B65D 25/287 206/139
4,441,336 A * 4/1984 Cannon ..... F25D 3/08 62/529

(Continued)

OTHER PUBLICATIONS

Country Cat, Arctic Cat Foam Beverage Can Holder—Snowmobile, ATV, Prowler, Wildcat, https://www.countrycat.com/arctic-cat/arctic-cat-1639-599-foam-beverage-holder-snowmobile-atv-prowler-wildcat, 2 pgs.

(Continued)

*Primary Examiner* — Amy J. Sterling
(74) *Attorney, Agent, or Firm* — Kagan Binder, PLLC

(57) ABSTRACT

A container holder for holding multiple cylindrical containers. The container holder includes a base, a cover and an insert. The base and the cover each have (a) two opposing equal size vertical side walls, (b) two opposing equal size vertical end walls, and (c) a bottom portion connected to lower ends of the side and end walls. The base and cover have substantially equal length and width so that the cover can be placed on the base to form an assembled container holder with a substantially rectangular cuboid outer surface. The assembled container holder defines an interior space having a height approximately equal to the height of the containers. The interior space of the assembled container holder is capable of accommodating multiple cans with the cans in an upright orientation. The hold insert may contain a freezable liquid for placement between the containers to keep beverages in the containers cool.

21 Claims, 6 Drawing Sheets

(56) References Cited

U.S. PATENT DOCUMENTS

D291,643 S * 9/1987 Morris ..... B65D 21/0231 D7/605
4,916,923 A * 4/1990 Adams ..... A45C 11/20 62/530
4,932,527 A * 6/1990 Hayes ..... B65D 81/3827 220/759
5,095,718 A * 3/1992 Ormond ..... F25D 3/08 206/427
5,257,509 A * 11/1993 Harris ..... A45C 3/02 206/544
5,522,239 A * 6/1996 Schwartz ..... B65D 81/18 62/530
5,564,597 A * 10/1996 Koorse ..... B67D 3/00 221/96
5,758,513 A * 6/1998 Smith ..... F25D 3/08 62/530
5,806,338 A * 9/1998 Schwartz ..... B65D 21/0231 62/530
6,067,813 A * 5/2000 Smith ..... A45C 11/20 62/530
D427,490 S * 7/2000 Hunter ..... F25D 31/007 D7/605
6,505,802 B2 1/2003 Fowler
9,618,252 B2 4/2017 Andrews

OTHER PUBLICATIONS

Spanky's Powersports, Beverage Holders, https://spankyspowersports.com/product/beverage-holders/#, 1 pg.
Choko, Snowmobile Tunnel Bag Foam cube Beverage Holder, Can holder 209008 00, https://www.ebay.com/itm/Choko-Snowmobile-Tunnel-Bag-Foam-Cube-Beverage-Holder-Can-Holder-209008-00-/293816517795, last updated Feb. 27, 2021, 4 pgs.
SP1 Beverage Holder Seven Can SM-16150 | eBay, https://www.ebay.com/itm/SP1-Beverage-Holder-Seven-Can-SM-16150/353324174490?_trkparms=aid%3D1110006%26algo%3DHOMESPLICE.SIM%26ao%3D1%26asc%3D20200818143230%26meid%3D0eea8e1466fc4b62bf7c49b176f42cd5%26pid%3D101224%26rk%3D2%26rkt%3D5%26mehot%3Dnone%26sd%3D293816517795%26itm%3D353324174490%26pmt%3D1%26noa%3D1%26pg%3D2047675%26algv%3DDefaultOrganic&_trksid=p2047675.c101224.m-1, last updated Mar. 16, 2021, 4 pgs.
B-pwr, https://b-pwr.com/en/content/72-drink-holder-snowmobile-cup-mounts, 2 pgs.

* cited by examiner

CONTAINER HOLDER

PRIORITY CLAIM

This application is a continuation-in-part application of U.S. Ser. No. 17/209,797, filed Mar. 23, 2021, the entirety of which is incorporated herein by reference, and claims priority to Canadian application having Serial Number 3,128,493 filed on Aug. 13, 2021.

FIELD OF THE INVENTION

The present invention relates generally to holders for beverage containers, and more particularly to holders for holding multiple beverage cans.

BACKGROUND OF THE INVENTION

Beverage holders for use in automotive vehicles are well known. Such holders typically just hold a single beverage container.

Particularly in recreational vehicles subject to substantial vibration, such as snowmobiles and motor boats, there is a need for a beverage holder for transporting multiple beverage containers, such as cans containing soda and beer, while keeping the beverage cool and reducing the amount of vibration transmitted to the beverage.

SUMMARY OF THE INVENTION

The following presents a simplified summary of the disclosure in order to provide a basic understanding to the reader. This summary is not an extensive overview of the disclosure and it does not necessarily identify key/critical elements of the invention or delineate the scope of the invention. Its sole purpose is to present some concepts disclosed herein in a simplified form as a prelude to the more detailed description that is presented later.

The present disclosure describes a container holder for holding N cylindrical containers, where N is a positive integer. All N containers have the same diameter, D, and the same height, H. The container holder includes a base and a cover. The base has (a) two opposing equal size vertical side walls, (b) two opposing equal size vertical end walls, and (c) a bottom portion connected to lower ends of the side and end walls. The bottom portion of the base has a substantially flat outer surface with a substantially rectangular shape. The side and end walls of the base are connected together so that the outer surfaces of the walls form a substantially rectangular cuboid.

The cover has (a) two opposing vertical side walls, (b) two opposing vertical end walls, and (c) a top portion connected to upper ends of the walls. The side and end walls of the cover are connected together so that the outer surfaces of the walls form a substantially rectangular cuboid.

The base and cover have substantially equal length and width so that the cover can be placed on the base to form an assembled container holder with a substantially rectangular cuboid outer surface. The assembled container holder defines an interior space, or region, having a height approximately equal to H, where the height of the interior space is the vertical distance between the interior surface of the bottom portion of the base and the interior surface of the top portion of the cover. The length and width of the base and cover are selected so that the interior space of the assembled container holder is capable of accommodating N cans with the cans in an upright orientation.

Preferably, N is an even positive integer, and the walls are sized and spaced apart so that N/2 containers are can be placed in an upright orientation in the interior space of the assembled container holder against a first side wall, and the other N/2 containers can then be disposed in an upright orientation in the interior space against the opposing second side wall. The container holder preferably also includes an insert sized to be placed in the interior space between the N/2 containers positioned against the first side wall and the other N/2 containers positioned against the second side wall. The insert has scalloped side walls, so each container is in contact with one of the scalloped portions of the side walls of the insert. The inner surfaces of the walls of the cover and base are preferably scalloped so that when the insert is in the interior space of the assembled container holder the scalloped portions of the walls are configured to form N cylindrical spaces each having a diameter of approximately D.

The insert preferably contains fluid.

The insert may be a refillable fluid container.

N may be equal to 6.

The cover and base are preferably formed from a flexible insulating material. The insulating material may be a polyurethane foam.

The bottom portion of the base; the side walls of the base, and the end walls of the base are preferably integrally formed, and the top portion of the cover, the side wads of the cover, and the end walls of the cover are preferably integrally formed.

D may be approximately 2.5-2.7 inches (63.5-68.6 mm). H may be approximately 4.5-4.75 inches (115-121 mm). H may be approximately 6.2-6.6 inches (157-168 mm). In general embodiments of the container holder are configured with D and H corresponding to the diameter and height of standard beverage cans.

The walls of the base and the cover all may have substantially the same height.

The interior space of the assembled container holder is preferably isolated from the surrounding environment by the base and cover.

The interior surfaces of the bottom portion of the base and the top portion of the cover may be substantially flat.

DETAILED DESCRIPTION OF THE INVENTION

Figure 1:
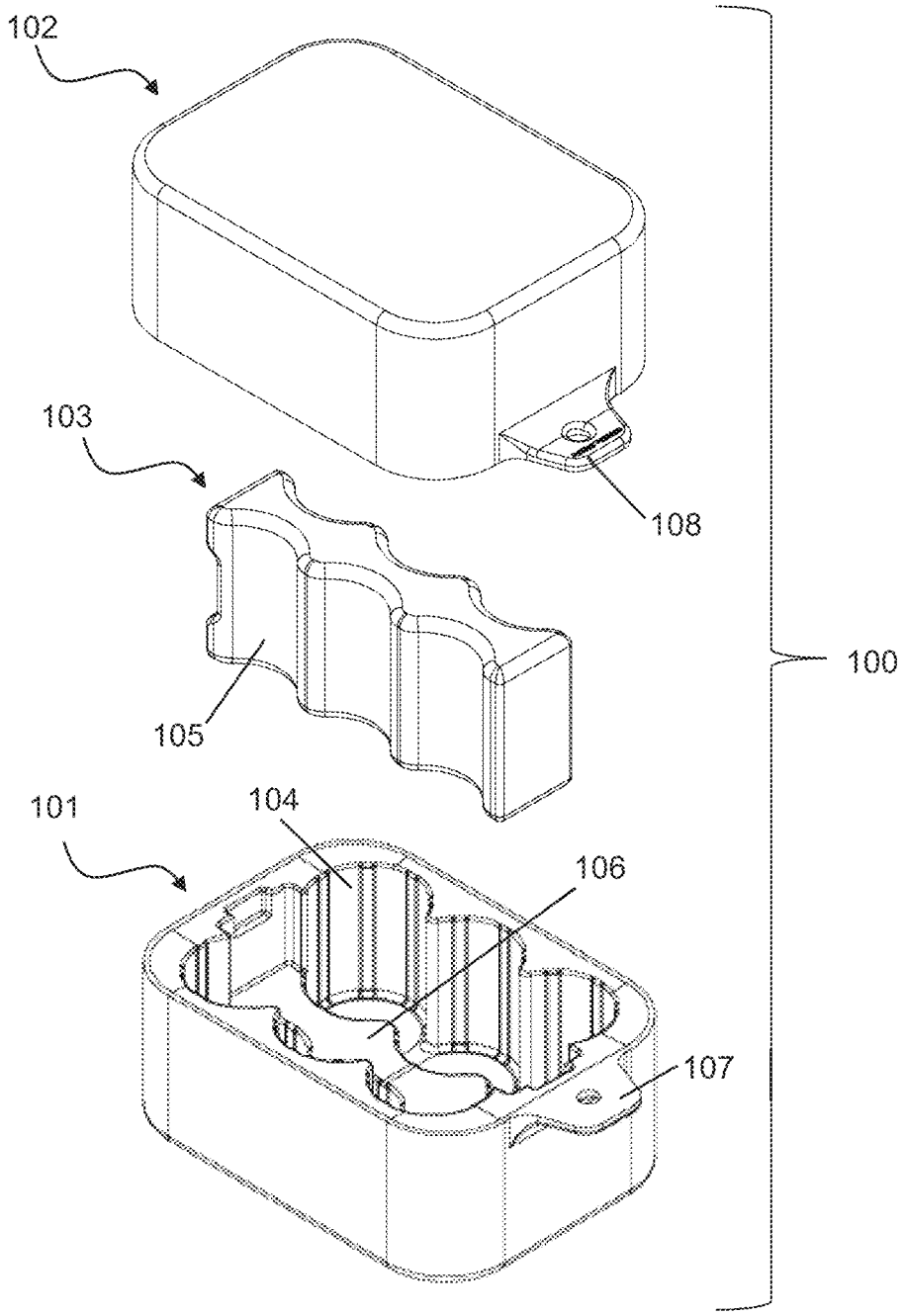
FIG. 1 is an exploded perspective view of a preferred embodiment of a container holder showing the cover, insert and base.
Figure 2:
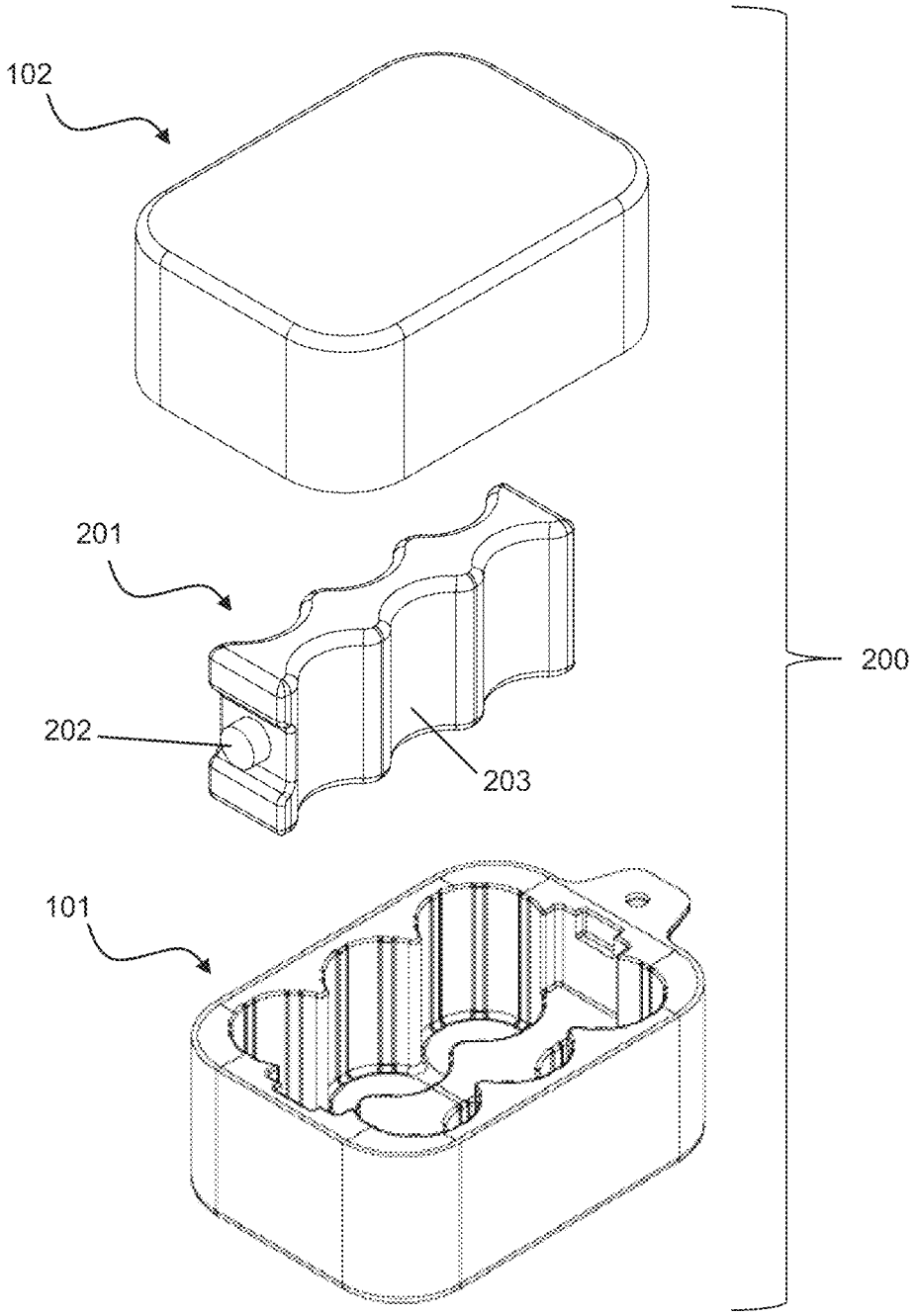
FIG. 2 is an exploded perspective view of another preferred embodiment of a container holder showing the cover, insert and base.
Figure 3:
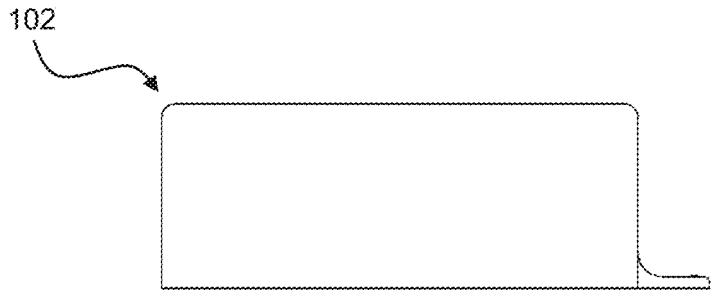
FIG. 3 is a side view of the cover of FIG. 1.
Figure 4:
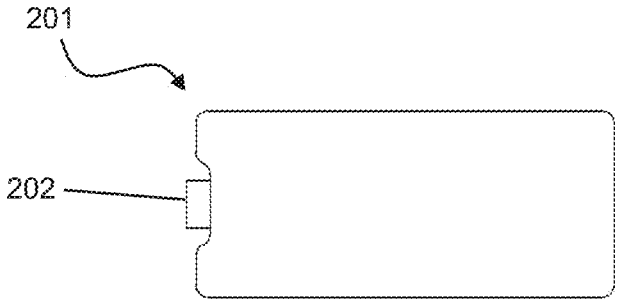
FIG. 4 is a side view of the insert of FIG. 2.
Figure 5:
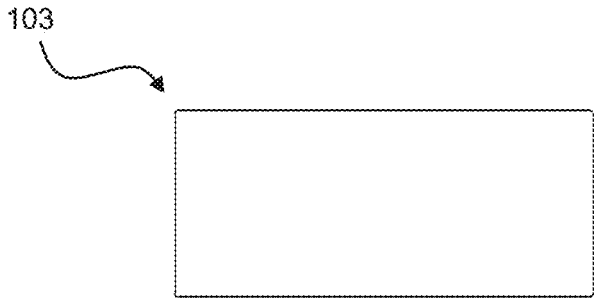
FIG. 5 is a side view of the insert of FIG. 1.
Figure 6:
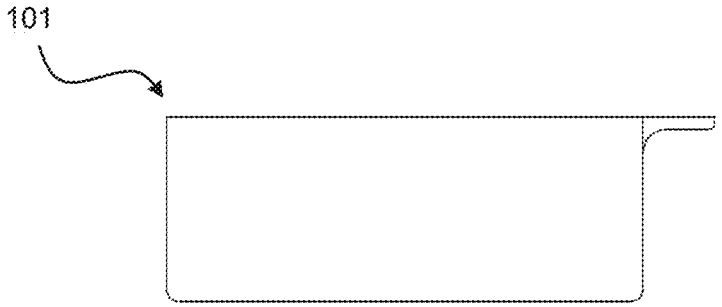
FIG. 6 is a side view of the base of FIG. 1.

FIG. 1 is an exploded perspective view of a preferred embodiment of a container holder 100 showing the cover 102, insert 103 and base 101. In this embodiment, the base 101 and cover 102 are substantially the same in this embodiment, having approximately equal height, length and width, however this is not essential as, for example, the heights of the cover and the base may differ. For example, the height of the cover may be less than the height of the base. Side views of the cover 102, insert 103 and base 101 are shown in FIGS. 3, 5 and 6. FIG. 2 depicts another preferred embodiment of a container holder 200 similar to the container holder 100 of FIG. 1, but with a refillable insert 201. A side view of the insert 201 of FIG. 2 is shown in FIG. 4.

The depicted container holder 100, 200 is configured to hold 6 cylindrical containers 1200 (see FIG. 12), which are typically cans, such as cans of soda, other soft drinks, or beer, which have the same diameter (D) and preferably the same height (H).

Figure 11:
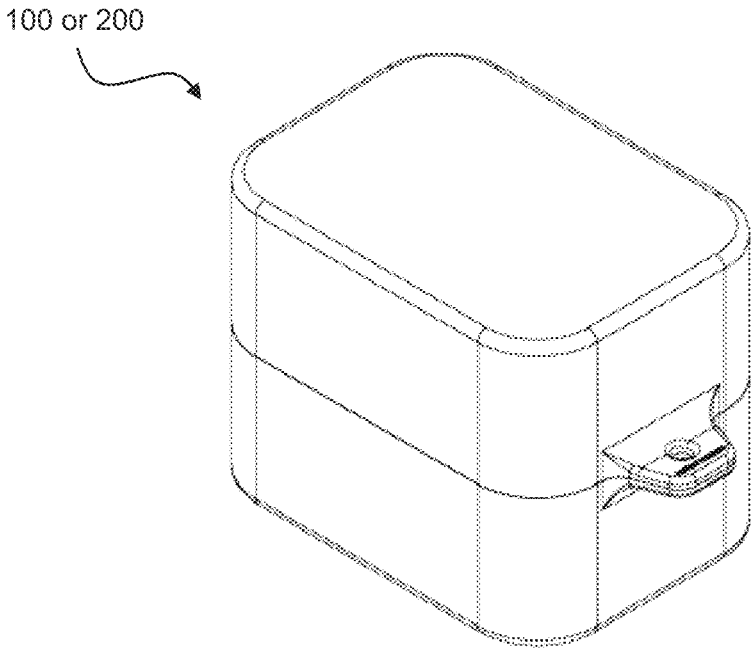
FIG. 11 is a perspective view of an embodiment of a container holder is an assembled or closed configuration.
Figure 12:
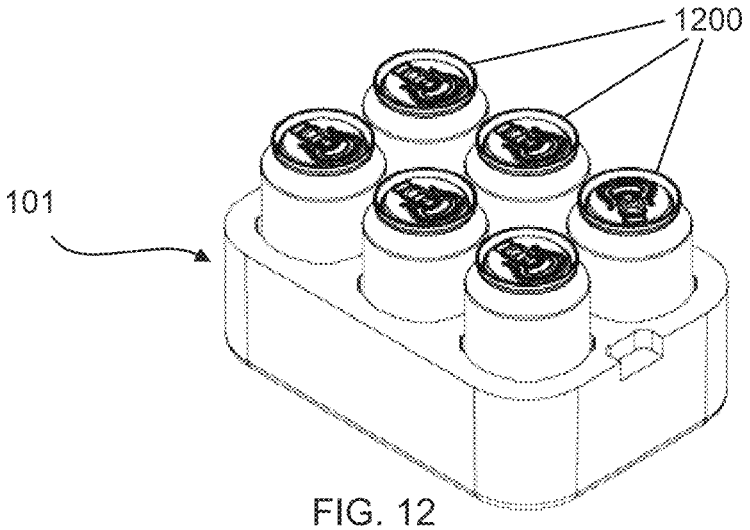
FIG. 12 is a perspective view of an embodiment of a container holder base with six beverage containers disposed in the base.

The base and cover have approximately equal length and width so that the cover can be placed on top of the base, thereby, as shown in FIG. 11, forming an assembled container holder, or a "container holder assembly", with an outer surface that is a substantially rectangular cuboid, as shown in FIG. 12, and interior surfaces defining an interior space that is isolated from the surrounding environment.

The base 101 and cover 102 both have similarly scalloped inner walls, as can be seen for the base 101 in FIG. 1. Each of the 6 base scallops 104 and 6 cover scallops has a semi-circular horizontal cross-section corresponding to a circle with a diameter of approximately D. When the cover 102 is placed on the base 101 with the walls aligned to form a substantially rectangular cuboid, the scallops in the base and cover are aligned with each other.

Figure 10:
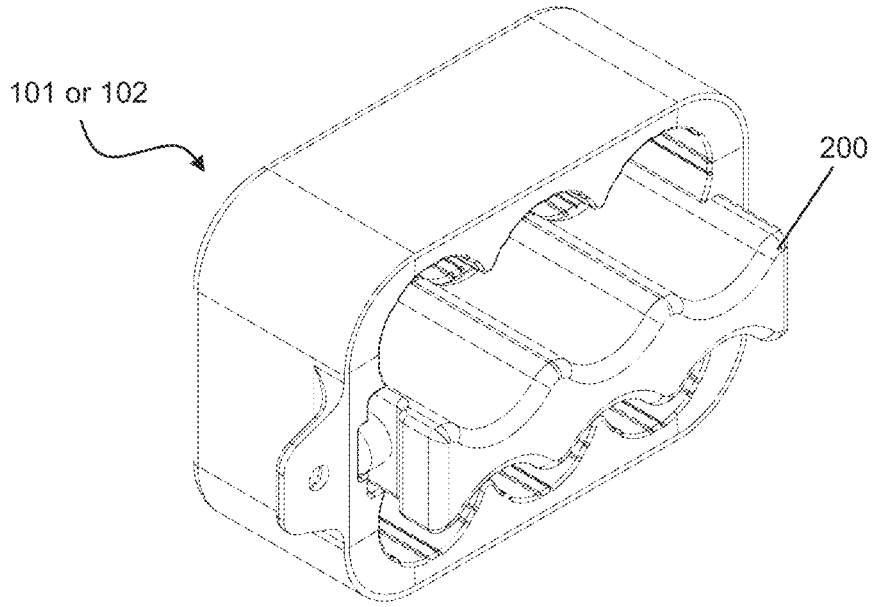
FIG. 10 is a perspective view of the base and insert of FIG. 2 showing the insert inserted into the base.

The insert 103, 201 has scalloped outer walls. Each insert scallop 105, 203 has a semi-circular horizontal cross-section corresponding to a circle with a diameter of approximately D. The length of the insert is approximately equal to the inner length of the base 101 and cover 102, which are approximately equal, the inner length being the distance between the inner surfaces of the two end walls in the centre of the base 101 and cover 102. The positions of the scallops 105, 203 on the insert 103 are configured to correspond to the base scallops 104 and cover scallops so that when the insert 103, 201 is inserted in the base 101 (as shown in FIG. 10) and the cover 102 is placed on top of the base 101 (as shown in FIG. 11) with the upper portion of the insert 103, 201 inside the cover 102, the scallops together define 6 cylindrical regions of diameter approximately equal to D and height approximately equal to H, so that 6 containers of diameter D and height H can be held inside the container holder assembly.

Figure 7:
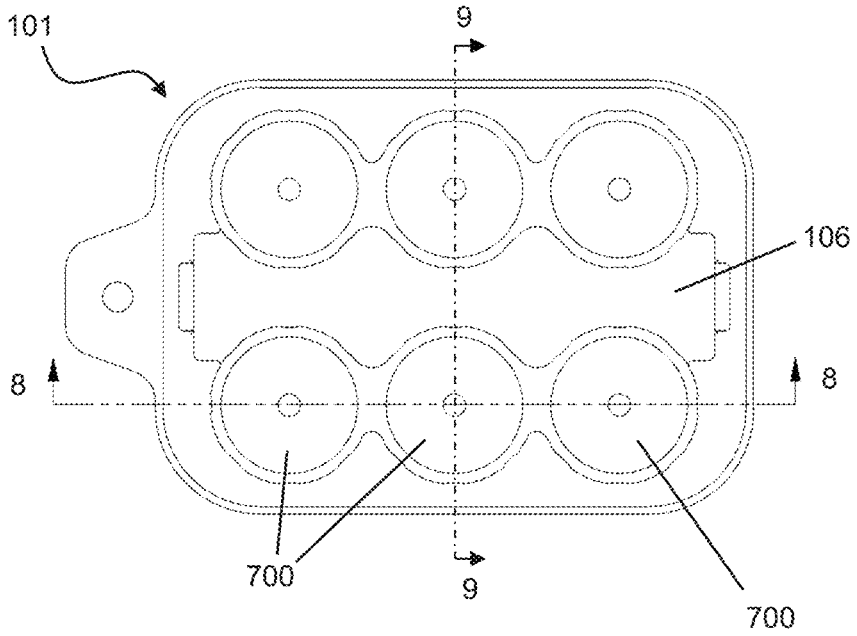
FIG. 7 is a top view of the base of FIG. 1.
Figure 9:
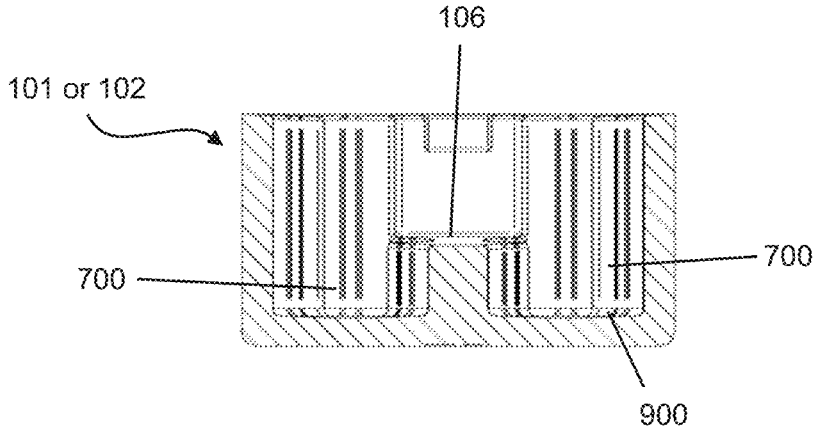
FIG. 9 is a cross-sectional view through the line 9-9 of FIG. 7.

The base 101 may have a lower landing 106 extending up from the inner surface of the base, and the cover 102 may have an upper landing extending down from the inner surface of the top portion of the cover. As shown in FIGS. 1 and 7, the landings preferably have the same horizontal cross-section as does the insert 103, with scallops corresponding to those of the insert. As can be seen in FIGS. 7 and 9, the scallops of the lower landing 106 together with those of the inner walls of the base together define 6 cylindrical regions 700 with a height equal to the height of the lower landing above the inner surface 900 of the bottom portion of the base 101. This facilitates placing the containers into the container holder and keeping them in place when the insert is not present, for example while one insert is removed and another is inserted, or when initially placing containers into the base 101. Similarly, the scallops of the upper landing together with those of the inner walls of the cover together define 6 cylindrical regions with a height equal to the vertical distance of the lower surface of the upper landing from the inner surface of the top portion of the cover 102. This facilitates further holding the containers in place when the container holder is assembled, as depicted in FIG. 11, with containers disposed in the interior space of the assembled container holder. The heights of the upper and lower landing are generally equal, but may be different.

The height of the insert 103, 201 is less than or equal to H, being less than or equal to approximately H less the sum of the heights of the upper and lower landings, if any.

Figure 8:
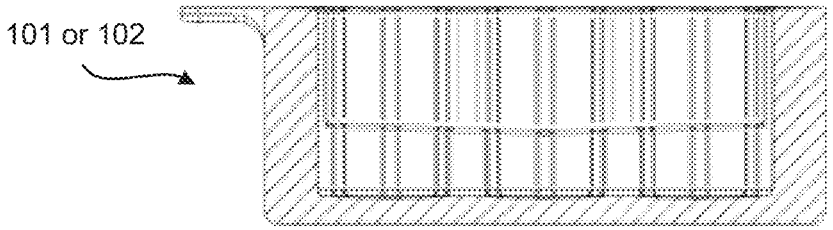
FIG. 8 is a cross-sectional view through the line 8-8 of FIG. 7.

Preferably the cover 102 has the same horizontal cross-sections as shown for the base 101 in FIGS. 8 and 9, although the heights of the cover and base may be different.

H is approximately equal to the vertical distance between the inner surface of the bottom of the base 101 and the inner surface of the top of the cover 102. The inner surface of the bottom of the base 101 and the top of the cover 102 refers to the surface at the top and bottom of each of the cylindrical regions formed when the container holder is assembled, with the cover on top of the base, ignoring any landings that may be present.

While it is not preferred, some embodiments may not include an insert and rely on landings on the inner surface of the bottom of the base and the top of the cover to secure the containers inside the container holder. In some embodiments, the lower landing may extend up to the level of the top ends of the walls of the base (e.g. as shown in FIG. 12) and the upper landing may extend down to the level of the bottom ends of the walls of the cover.

Preferred embodiments include an insert filled with, or that is fillable with, a fluid (liquid or gel), such as distilled water or tap water. The insert filled with fluid can be placed in a freezer to reduce the temperature of the fluid to 0 degrees Celsius or less. In the case water is used, it turns into ice when cooled to 0 degrees Celsius or less. Other fluids may or may not freeze. When the insert is removed from the freezer and placed in a container holder base with containers placed in the base and the cover is placed on top of the base, the scalloped sides of the insert are proximate to, and most preferably in contact with, portions of the sides of the cylindrical containers so that heat is efficiently exchanged between the insert and the contents of the containers. Assuming the containers and their contents are warmer than the insert, the temperature of the containers and the liquid they contain are thereby reduced, or the temperature of the containers and the liquid they contain is maintained at a temperature lower than the environment surrounding the container holder.

The insert may be made from any suitable material, such as polypropylene. It may be clear or translucent. The insert may be pre-filled with a fluid before the insert is sold. In such embodiments, a fluid may be used that has a freezing point below 0 degrees Celsius, such as propylene glycol.

Alternatively an additive, such as propylene glycol, may be added to water to reduce the freezing point of the water. It is preferred that the fluid be non-toxic.

In some embodiments, the insert 201 is refillable and has an opening with a cap 202 that can be removed to pour out the fluid in the insert 201 and refill the insert 201 with fluid. The cap is then replaced.

The cover and base are preferably formed from a flexible insulating material, for example a thermoplastic foam such as polyurethane foam, which is selected to help vibrationally isolate containers, and their contents, in the interior space of the assembled container holder. This is particularly useful where the container holder is used in vehicles such as snowmobiles, jet skis, off-road vehicles, and motor boats that are subject to substantial vibration and irregular forces. The insulating material dampens the vibrations of the vehicle to reduce the amount of vibration transmitted to the contents of the containers disposed in the container holder, which is particularly useful when the contents of the containers are carbonated beverages such as soda (also known as "soda pop" or just "pop") or beer. The insulating material also reduces heat exchange between the containers (and the liquid in the containers) and the surrounding environment.

The insert may be a commercially available product such as a Freez Pak™ 6 pack coolant made by Lifoam Industries, a Kleager Can Beer Ice Pack for Lunch, or a 6 Can Long Lasting Ice Pack made by Healthy Packers.

The insert may be alternatively made from an insulating material, such as the same material used to make the cover and base, for example, a thermoplastic foam such as polyurethane foam. Such an insert may be preferable for use in cold conditions, such as below 0 degrees Celsius when snowmobiling, so that the container holder securely holds the containers but helps to prevent the contents of the containers from freezing by limiting heat exchange between the environment and the contents of the containers. A container holder comprising a cover, base and foam insert may be sold to consumers, who can purchase suitable commercial ice packs as inserts for summer use, for example.

Figure 15:
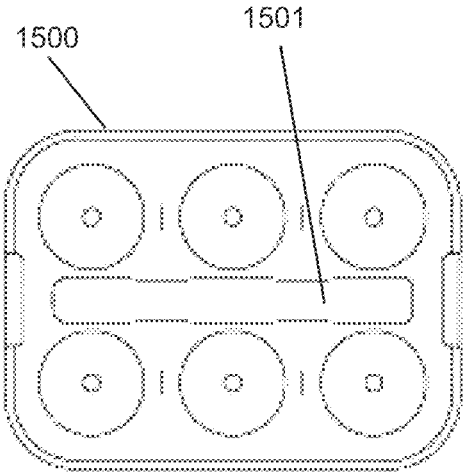
FIG. 15 is a top view of an embodiment of a base or a bottom view of a corresponding embodiment of a cover.
Figure 16:
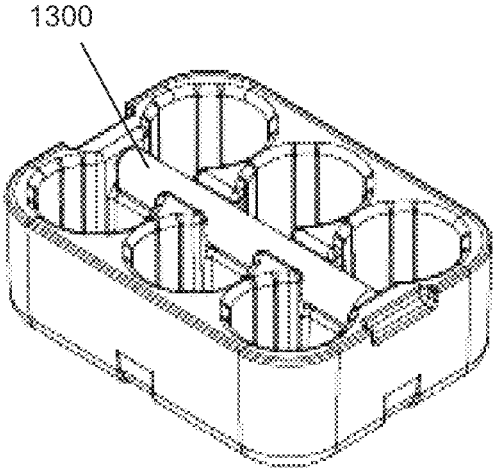
FIG. 16 is a perspective view of the base or cover of FIG. 15 with a cylindrical insert disposed therein.

FIG. 15 depicts an embodiment of an embodiment of a base 1500, or a corresponding embodiment of a cover, configured to receive a generally cylindrical insert 1300. The base and cover may be configured similarly, although there may be some differences, such as markings, height, protrusions, landing configuration, etc. The cover may be placed on the base to form an assembled container holder with a substantially rectangular cuboid outer surface as depicted in FIG. 11, The cover and base may each have a landing 1501 which is proximate to, or abuts, the cylindrical insert when the insert 1300 is disposed in the base 1500, as shown in FIG. 16, or the cover. Alternatively, only the base may have a landing 1501.

Figures 13, 14:
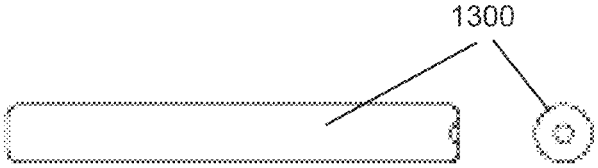
FIG. 13 is a plan side view of a cylindrical embodiment of an insert.
FIG. 14 is an end view of the cylindrical insert of Figure showing one end of the insert, which is circular.

While the generally cylindrical insert may be strictly cylindrical, as shown in FIGS. 13 and 16, it is referred to herein as "generally cylindrical" to indicate that it may vary relative to a strict cylinder. For example, the diameter of the insert may vary along the longitudinal axis of the insert, although it is preferred that the insert be strictly cylindrical (which may be referred to as a rod). The ends of the insert may also be rounded in some embodiments. The height of the landing and diameter of the cylindrical insert are preferably selected so that when the insert is disposed in the base (or cover), abutting the landing, the top of the insert does not extend higher than the side and end walls of the base (or lower than the side and end walls of the cover). The inner surfaces of the end walls are preferably configured to be spaced apart by about the length of the insert, so when the insert is disposed in the base (or cover) the ends of the insert are frictionally engaged with the end walls, helping to keep the insert in a fixed position. In this way, embodiments may be configured to receive one insert in the base and a second insert in the cover, in which case a user could choose to use either one or two inserts.

As with the other embodiments of inserts discussed above, the generally cylindrical inserts may be filled with, or be Tillable with, a fluid (liquid or gel), and generally function as discussed above.

The base and insert are configured so that when the cylindrical insert is disposed in the base, then a portion of the insert is proximate to, or abuts (i.e. is in contact with), each container disposed in the base. Similarly for the cover in embodiments where an insert may also be inserted in the cover.

It is preferred that the bottom portion of the base, including any landing, the side walls of the base, and the end wads of the base are integrally formed, and also that the top portion of the cover, including any landing, the side walls of the cover, and the end walls of the cover are integrally formed. The cover and base may each be formed by injection molding.

While the embodiments of the container holders depicted in the drawings are configured to hold 6 cans, other embodiments may be configured to hold, for example, 2, 4, 8, 10, 12 or more containers. It is preferred that the number of containers be even, but this is not essential.

While the multiple containers that are disposable (i.e. can be placed or disposed) in a container holder are generally assumed to have the same diameter and height, this is not essential. For example one of more of the containers may have a height less that the height of the other containers. Such shorter containers may not be held in place as securely as those having a height approximately equal to the height of the interior space, but they can still be accommodated. However, it is generally the case that the container holder is capable of holding multiple containers that do have the same diameter and height. In some embodiments, the container holder may be configured to hold containers of differing diameters, but this is not preferred.

References to terms such as "vertical", "horizontal", "up" "down", "down", "upright" as used herein assume that the container holder is assembled, with the cover on top of the base and the bottom surface of the base is parallel to the ground or floor, as depicted in FIG. 11.

As used herein "approximately" means +/−5% unless otherwise stated.

The qualifier "substantially" as used in "substantially rectangular cuboid" means that the horizontal and vertical cross-sections of the substantially rectangular cuboid need not be strictly rectangular, but may, for example, have rounded corners, as can be seen in the figures. Where the term "rectangular cuboid" is used herein without this qualifier, the term is to be interpreted to mean a "substantially rectangular cuboid". A substantially rectangular cuboid, as used herein, may also have protrusions 107, 108 from the base 101 and cover 102.

The qualifier "substantially" as used in "substantially flat" in respect of a surface means that the subject surface need not be strictly flat, but may, for example, have indentations, extensions ("feet") or landings spanning an aggregate of less than 70%, and preferably less than 50%, of the area of the surface. Where the term "flat" is used herein without this qualifier, the term is to be interpreted to mean "substantially flat".

The term "cylindrical container" as used herein means that the container has a strictly cylindrical portion, but may also have narrowed portions at the top and bottom of the container, or elsewhere. For example, the cylindrical containers 1200 depicted in FIG. 12 have a narrowed portion at the top of the containers, as do standard commercially used soda and beer cans.

The abbreviation mm as used herein refers to millimetres (or in the US, "millimeters"). The abbreviation cm as used herein refers to centimetres (or in the US, "centimeters").

Where, in this document, a list of one or more items is prefaced by the expression "such as" or "including", is followed by the abbreviation "etc.", or is prefaced or followed by the expression "for example", or "e.g.", this is done to expressly convey and emphasize that the first is not exhaustive, irrespective of the length of the list. The absence of such an expression, or another similar expression, is in no way intended to imply that a list is exhaustive. Unless otherwise expressly stated or clearly implied, such lists shall be read to include all comparable or equivalent variations of the listed item(s), and alternatives to the item(s), in the list that a skilled person would understand would be suitable for the purpose that the one or more items are listed.

Unless expressly stated, or otherwise clearly implied herein, the conjunction "or" as used in the specification and claims shall be interpreted as a non-exclusive "or" so that "X or Y" is true when X is true, when Y is true, and when both X and Y are true, and "X or Y" is false only when both X and Y are false.

The words "comprises" and "comprising", when used in this specification and the claims, are used to specify the presence of stated features, elements, integers, steps or components, and do not preclude, nor imply the necessity for, the presence or addition of one or more other features, elements, integers, steps, components or groups thereof.

It should be understood that the above-described embodiments of the present invention, particularly, any "preferred" embodiments, are only examples of implementations, merely set forth for a clear understanding of the principles of the invention. Many variations and modifications may be made to the above-described embodiment(s) of the invention as will be evident to those skilled in the art. That is, persons skilled in the art will appreciate and understand that such modifications and variations are, or will be, possible to utilize and carry out the teachings of the invention described herein.

The scope of the claims that follow is not limited by the embodiments set forth in the description. The claims should be given the broadest purposive construction consistent with the description and figures as a whole.

What is claimed is:

1. A container holder for holding N cylindrical containers disposed in the container holder, where N is a positive integer, all containers having the same diameter, D, and the same height, H, the container holder comprising:

a base comprising (a) two opposing vertical side walls of equal height and width, each having inner and outer surfaces, (b) two opposing vertical end walls of equal height and width, each having inner and outer surfaces, the side and end walls being connected together so that the outer surfaces of the walls form a substantially rectangular cuboid, and (c) a bottom portion connected to lower ends of the side and end walls, and having a substantially flat outer surface having a substantially rectangular shape, wherein the inner surfaces of the walls are scalloped to contact outer portions of walls of the containers;

a cover comprising (a) two opposing vertical side walls of equal height and width, each having inner and outer surfaces, (b) two opposing vertical end walls of equal height and width, each having inner and outer surfaces, the side and end walls being connected together so that the outer surfaces of the walls form a substantially rectangular cuboid, and (c) a top portion connected to upper ends of the walls, wherein the inner surfaces of the walls are scalloped to contact outer portions of walls of the containers; and an insert, wherein the base and cover have substantially equal length and width so that the cover is placeable on the base to form an assembled container holder with a substantially rectangular cuboid outer surface, the assembled container holder defining an interior space having a height approximately equal to H, the height of the interior space being the vertical distance between an interior surface of the bottom portion of the base and an interior surface of the top portion of the cover, wherein the insert is sized to be removably placed into the interior space of the assembled container holder between the containers disposed against the scalloped inner surfaces of the base and cover, so that a portion of each container is proximate to or in contact with the insert, wherein the length and width of the base and cover are selected so that the interior space is capable of accommodating the containers therein with the containers in an upright orientation, wherein the cover has a scalloped upper landing extending down from the inner surface of the top portion of the cover and a lower landing extending up from the inner surface of the base, wherein the landings are situated above and below the position of the insert.

2. The container holder of claim 1, wherein N is an even positive integer, and the walls are sized and spaced apart so that N/2 containers are disposable in an upright orientation in the interior space against a first side wall, and the other N/2 containers are disposable in an upright orientation in the interior space of the assembled container holder against the opposing second side wall.

3. The container holder of claim 2, wherein the insert has scalloped side walls, so each container disposed in the interior space is proximate to or in contact with one of the scalloped portions of the side walls of the insert.

4. The container holder of claim 3, wherein the inner surfaces of the walls of the cover and base are scalloped so that when the insert is in the interior space of the assembled container holder the scalloped portions of the walls are configured to form N cylindrical spaces each having a diameter of approximately D.

5. The container holder of claim 3, wherein the insert contains fluid.

6. The container holder of claim 3, wherein the insert is a refillable fluid container.

7. The container holder of claim 3, wherein the insert is made from a flexible insulating material.

8. The container holder of claim 2, further comprising a first generally cylindrical insert having a length along a longitudinal axis between two ends of the insert, and being sized to be placed in the interior space of the assembled container holder between the N/2 containers disposed against the first side wall and the other N/2 containers disposed against the second side wall, so that each container is proximate to or in contact with a portion of the insert.

9. The container holder of claim 8, wherein the opposing vertical end walls of the base are configured so that the distance between the inner surfaces of the opposing vertical end walls is approximately equal to the length of the first generally cylindrical insert so that the inner surfaces of the opposing end walls frictionally engage the first generally cylindrical insert when the first generally cylindrical insert is disposed in the base.

10. The container holder of claim 9, wherein the opposing vertical end walls of the cover are configured so that the distance between the inner surfaces of the opposing vertical end walls is approximately equal to the length of a second generally cylindrical insert so that the inner surfaces of the opposing end walls frictionally engage the second generally cylindrical insert when the second generally cylindrical insert is disposed in the cover.

11. The container holder of claim 1, wherein N is equal to 6.

12. The container holder of claim 1, wherein the cover and base are formed from a flexible insulating material.

13. The container holder of claim 12, wherein the insulating material is a polyurethane foam.

14. The container holder of claim 1, wherein the bottom portion of the base, the side walls of the base, and the end walls of the base are integrally formed, and the top portion of the cover, the side walls of the cover, and the end walls of the cover are integrally formed.

15. The container holder of claim 1, wherein D is approximately 2.5-2.7 inches (63.5-68.6 mm).

16. The container holder of claim 15, wherein H is approximately 4.5-4.75 inches (115-121 mm).

17. The container holder of claim 15, wherein H is approximately 6.2-6.6 inches (157-168 mm).

18. The container holder of claim 1, wherein the walls of the base and the cover all have substantially the same height.

19. The container holder of claim 1, wherein the interior space of the assembled container holder is isolated from the surrounding environment by the base and cover.

20. The container holder of claim 1, wherein the interior surfaces of the bottom portion of the base and the top portion of the cover are substantially flat.

21. The container holder of claim 1, wherein the side and end walls of the base are connected together so that the outer surfaces of the walls form a rectangular cuboid with rounded corners, and the side and end walls of the cover are connected together so that the outer surfaces of the walls form a rectangular cuboid with rounded corners.

* * * * *